United States Patent [19]

Kochis

[11] 4,124,955

[45] Nov. 14, 1978

[54] AUTOMATIC CLOSURE

[75] Inventor: August J. Kochis, Concord, Mass.

[73] Assignee: Eckel Industries, Inc., Cambridge, Mass.

[21] Appl. No.: 796,805

[22] Filed: May 13, 1977

[51] Int. Cl.[2] ..... E05F 1/04

[52] U.S. Cl. ..... 49/237; 49/9; 160/354

[58] Field of Search ..... 49/237, 9, 238, 239, 49/34; 160/354

[56] References Cited

U.S. PATENT DOCUMENTS

| | | | |
|---|---|---|---|
| 785,550 | 3/1905 | Hess et al. | 49/237 |
| 3,146,826 | 9/1964 | Eckel | 49/9 |
| 3,272,257 | 9/1966 | Dirubbo | 160/354 |
| 3,384,996 | 5/1968 | Gilchrist et al. | 49/9 |
| 3,420,290 | 1/1969 | Dirubbo | 160/354 |
| 3,750,739 | 8/1973 | McGuire | 49/9 |
| 3,858,357 | 1/1975 | McGuire | 160/354 X |

FOREIGN PATENT DOCUMENTS

| | | | |
|---|---|---|---|
| 544,793 | 2/1956 | Belgium | 160/354 |

*Primary Examiner*—Philip C. Kannan
*Attorney, Agent, or Firm*—Schiller & Pandiscio

[57] ABSTRACT

Apparatus is disclosed for use with an automatic closure of the type wherein the closure member, such as a door, returns to a home position when displaced therefrom. The closure member is at least partially supported by a hanger arm secured to a cam follower that rides on a cam track. The cam track forms part of a stationary structure which provides a bearing for a rotatable post. The post may carry further support means for the closure member.

15 Claims, 5 Drawing Figures

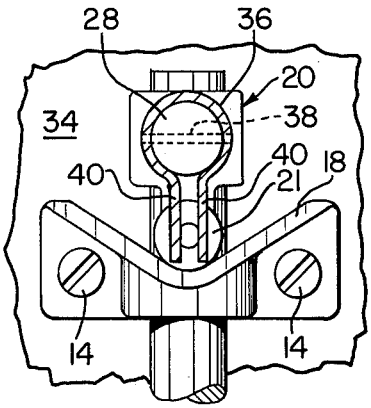
FIG. 2
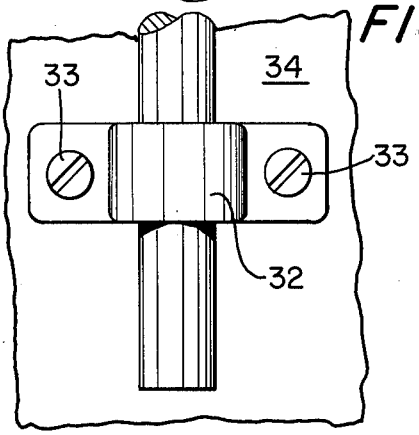
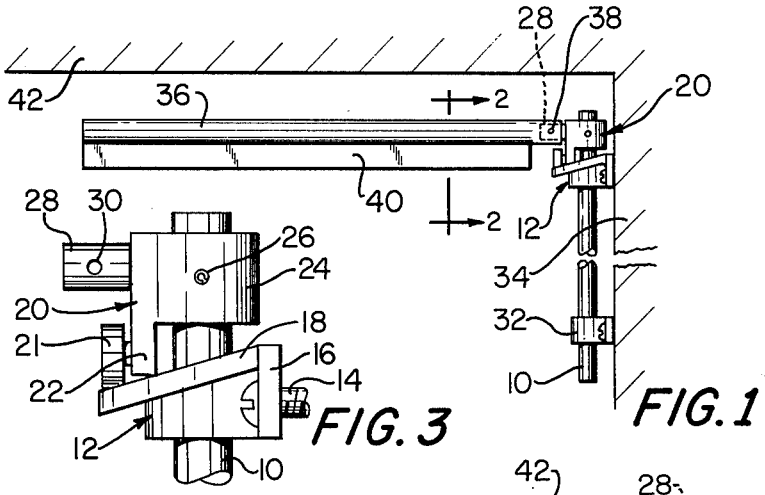
FIG. 3
FIG. 1
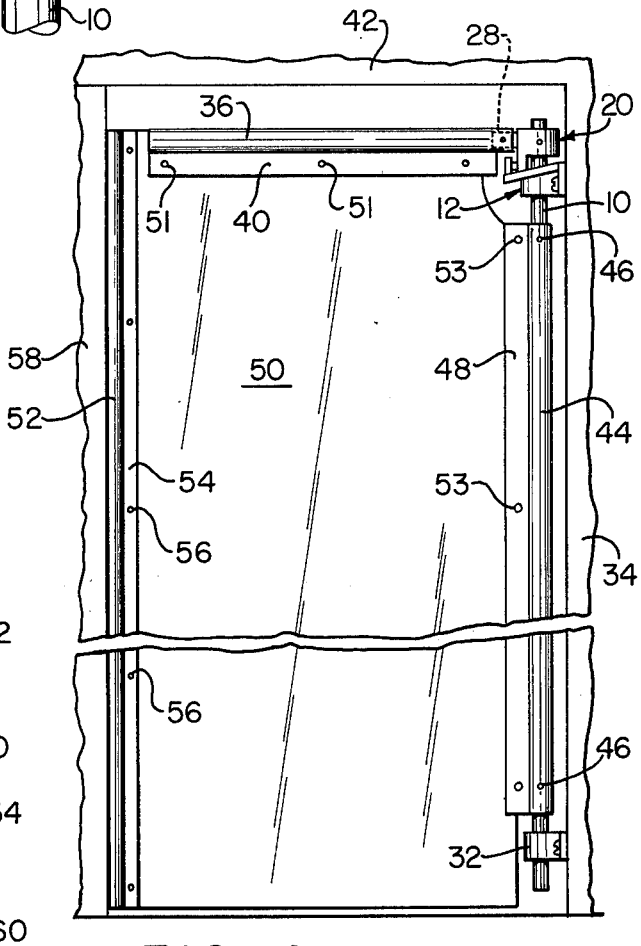
FIG. 4
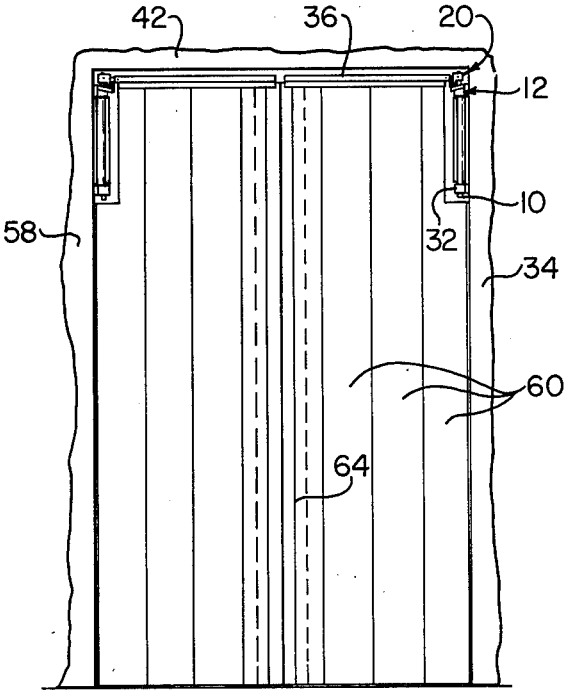
FIG. 5

AUTOMATIC CLOSURE

BACKGROUND OF THE INVENTION

The present invention relates in general to new and improved automatic closures and in particular to improvements for providing support for a closure member, such as a door or the like.

Closure members which automatically return to a preferred position are well known in the art. Various types of devices are commonly employed to cause a door to assume such a position, e.g. a closed position. One such device is shown in U.S. Pat. No. 3,384,996 and consists of a stationary cam track on which a cam follower rides. The cam follower is secured to a post which extends through the cam track and is rotatably journaled in a bearing integral with the track. Fastening means secured to the post support the door along a vertical edge and cause it to rotate with the post.

In general, automatic closures of this type provide satisfactory performance when used with relatively rigid closure members. Thus, when a door is moved out of its normally closed position by a person entering the doorway, or by an object pushed through the doorway, the rigidity of the door assures that the doorway is clear for passage as long as torque continues to be applied to the door. Such is not the case however where relatively thin and/or flexible closure members are employed, e.g. where the closure member comprises a single panel made of a flexible sheet of plastic, as may be the case in inexpensive light weight closures. For certain types of closures such panels may be stiff but resiliently flexible. For other closures the plastic sheet may essentially comprise a flexible, limp curtain.

If torque is applied to a flexible closure member to move it out of its normal position, the lack of rigidity will produce flexing in addition to rotation of the member, and in some cases the flexing may result in the closure member not rotating to full open position. Under these conditions, portions of the closure member may continue to block the doorway and provide interference with objects passing through. Thus, additional frictional contact between the object and the closure member will occur and the possibility of damage to the latter will be enhanced.

OBJECTS OF THE INVENTION

Accordingly, it is a primary object of the present invention to provide a new and improved automatic closure which is not subject to the foregoing disadvantages.

It is another object of the present invention to provide an automatic closure wherein clearance of a passage normally closed by a flexible closure member is readily obtained.

It is a further object of the present invention to provide an automatic closure including a flexible door wherein the possibility of damage to the door is minimized.

These and other objects of the present invention, together with the features and advantages thereof, will become apparent from the following detailed specification when read in conjunction with the accompanying drawing in which corresponding parts are designated by like reference numerals in the separate views shown.

BRIEF DESCRIPTION OF THE DRAWING

FIG. 1 illustrates a preferred embodiment of the present invention;

FIG. 2 is a cross-sectional view of the apparatus of FIG. 1 taken at line 2 — 2;

FIG. 3 is a detail view of the apparatus of FIG. 1;

FIG. 4 illustrates the present invention in combination with a door; and

FIG. 5 illustrates the present invention in combination with a different type of door.

DESCRIPTION OF THE INVENTION

With reference now to the drawings, FIGS. 1 and 2 show an overall view of a preferred embodiment of the present invention while the mechanism per se, which returns the closure member to a home position, is best shown in FIG. 3. A post 10 is rotatably journaled in a bearing 12 and it is also axially slidable therein. A pair of screws 14 extends through suitable holes in flange 16 of bearing 12 to mount the bearing on a stationary structure, such as door jamb 34. Bearing 12 further includes a semicircular cam track 18 which partially encircles post 10 and which is integral with the bearing. The track rises in height on both sides of a central low point.

A cam follower 20 comprises a support structure 24 and a roller 21 rotatably disposed on an extension 22 of support structure 24. The roller is positioned to follow track 18 and has a home position at the low point on the track to which it seeks to return. Support structure 24 is secured to post 10 above the track by means of pin 26 and is adapted to rotate jointly with the post. A boss 28 is integral with support structure 24 and is positioned on the latter so that its axis is substantially perpendicular to the axis of post 10. Boss 28 further includes a bore 30 which is adapted to receive a fastening pin.

Post 10 is further journaled in a bearing 32 which is spaced from bearing 12 and positioned coaxially below the latter. Post 10 is also axially slidable in bearing 32. Bearing 32 is fastened to door jamb 34 by means of screws 33 which thread into the jamb. Thus, post 10 is positioned parallel to the jamb and spaced therefrom. As best seen from FIG. 2, a split sleeve 36 is coaxially mounted on boss 28 and is secured to the latter by means of a pin 38 which engages bore 30. Sleeve 36 extends in a direction substantially perpendicular to post 10 and includes a pair of parallel flanges 40 of substantially the same length. The sleeve is positioned on the boss so that flanges 40 are substantially parallel to a vertical plane. Preferably sleeve 36 is made of metal, e.g. aluminum.

FIG. 4 illustrates the present invention in combination with a self-closing door, applicable reference numerals having been carried forward. The doorway is defined by a lintel 42 and a pair of door jambs 34 and 58. Bearings 12 and 32 are both mounted on jamb 34 so as to rotatably support post 10 parallel thereto. A split sleeve 44, which is similar in construction to sleeve 36, is coaxially mounted on post 10 and is secured thereto by means of pins 46. Sleeve 44 further includes a pair of parallel flanges 48 substantially coextensive in length with the sleeve. Only one of flanges 48 is visible in FIG. 4. Sleeve 44 is mounted on post 10 so that flanges 48 are substantially parallel to a vertical plane.

Flange pairs 40 and 48 are aligned with each other so as to jointly define a vertical plane straddled by each flange pair. A panel 50 is positioned in the plane so defined, such that its upper horizontal edge is gripped between flanges 40 and its right hand vertical edge is gripped between flanges 48. Flanges 40 and 48 are preferably fastened to the panel by means of rivets 51 and 53 respectively.

The left hand edge of panel 50 is held between flanges 54 of a flexible, protective nosing 52, only one flange of which is visible in FIG. 4. Flanges 54 are fastened to panel 50 by means of rivets 56. In the closed position of the door, nosing 54 substantially abuts door jamb 58.

The apparatus which forms the subject of the present invention is advantageously employed in conjunction with closure members having flexible panels. For the sake of illustration, let it be assumed that panel 50, which constitutes the major portion of the door, consists of a flexible, resilient material having only limited stiffness. Typically the door is dislodged from its closed position by pushing against a limited portion of the panel, for example by means of a loaded dolly wheeled into the doorway. In the absence of sleeve 36, the flexibility of panel 50 obstructs the establishment of a torque couple that will rotate the door sufficiently to provide the necessary clearance throughout the full extent of the doorway. As a consequence, contact between the panel and the load passing through the doorway is greater than it would be with sleeve 36 present and the possibility of damage to panel 50 is increased.

By enhancing the stiffness of the door along the upper horizontal edge, sleeve 36 serves to lessen the chance of damage thereto. Thus, the moment of force about the axis of post 10 is directly transmitted to post 10 through substantially rigid sleeve 36, boss 28 and cam follower 20. Since the flanges of sleeves 36 and 44 are substantially co-planar and they grip mutually perpendicular edges of panel 50, the latter will more closely retain its original planar configuration when force is applied to a limited portion thereof. Hence, a larger portion of the doorway will be cleared than would be the case in the absence of sleeve 36.

When the force applied to panel 50 is released, the action of cam follower 20 causes roller 21 to return to its home position which is chosen to coincide with the closed position of the door. Here too, sleeve 36 assists in maintaining the planar configuration of panel 50 and acts to return the door to its closed position with less flexing than would otherwise be the case.

It is important to understand that sleeve 36 serves to limit flexing of panel 50 about a vertical axis. Flexing about a horizontal axis is limited to some extent by the presence of resilient nosing 52. It should be noted, however, that the primary function of nosing 52 is to provide a protective cover for the left hand panel edge as well as to provide protection for the contacting door jamb 58.

The presence of relatively rigid sleeve 36 makes possible the use of flexible panel materials that provide the closure member with characteristics that are peculiarly suited to different specialized purposes. For example, some applications require a flexible, resilient light weight panel which is also transparent. Such a panel, e.g. a panel made of clear LUCITE®, can replace a heavy, substantially rigid door structure having glass inserts for viewing through the door. In addition to being easily deflected by loads pushed through the self-closing door, such a panel has the added advantage of resisting shattering and other damage that may occur in a conventional door subjected to such treatment. Further, the danger of injury to person or object, which is ever-present where a self-closing door is used, particularly one without damping means, is materially reduced in the present invention due to the lightness of the overall structure.

FIG. 5 illustrates the present invention in combination with a double door wherein the door panel is in the nature of a curtain. As before, applicable reference numerals have been carried forward. Substantially identical doors are supported on opposite door jambs 34 and 58. Each panel comprises a series of flexible, limp plastic strips 60 which overlie each other and which are suspended by their horizontal upper edges gripped between the flanges of split sleeve 36.

In the embodiment of the invention illustrated in FIG. 5, the inner door edge 64 may, but need not be, stiffened to enable force to be applied against it. Thus, a double door is provided which, although extremely light in weight and easily deflected from its normally closed position, provides an effective closure member for a doorway. This embodiment offers the advantage that the strips 60 will yield and may be parted to allow a person or small object to pass through the doorway, or else each of the two multi-strip panels can be pivoted about the axis of port 10 to a fully open position.

It will be apparent that the invention described above lends itself to various modifications and changes. For example, although boss 28 is disclosed as being of limited length, the invention is not so limited. A longer boss, preferably of hollow construction, may be provided and sleeve 36 may be fastened thereto at more than one point.

In FIG. 4 flanges 40 are shown as being riveted to panel 50. Although desirable, such fastening means are not required, particularly where a resilient panel is used which is firmly gripped between the flanges.

Other modifications, variations and substitutions will now occur to those skilled in the art all of which fall within the spirit and scope contemplated by the present invention. Hence it is intended that the present invention be limited only by the appended claims.

What is claimed is:

1. A combination support and automatic closure apparatus for use with a door panel, said apparatus comprising:

journaling means including at least one bearing;

a vertical post rotatably supported adjacent its upper end in said bearing;

a cam track integral with said bearing;

a cam follower comprising a support section surrounding and affixed to said post and a follower section disposed to follow said track, said cam follower being adapted to return to a home position on said track when displaced therefrom;

fastening means secured to said support section of said cam follower and extending in a direction substantially perpendicular to said post; and first and second split sleeves coaxially mounted on said fastening means and on said post respectively for joint movement about the axis of said post;

each of said sleeves including a pair of parallel flanges running substantially the length of the corresponding sleeve;

said flange pairs being positioned to bracket mutually perpendicular edges of a common plane defined therebetween, whereby a top edge section and a side edge section of a panel may be disposed between and supported by the flanges of said first and second sleeves respectively.

2. Apparatus according to claim 1 wherein said cam track at least partially encircles said post, said home position comprising a low point on said track defining a normal rotational position of said plane.

3. Apparatus according to claim 2 wherein said journaling means further comprises a second bearing positioned below said first recited bearing and spaced therefrom, said bearings being coaxially mounted on a fixed surface and supporting said post in a substantially vertical position;

means for securing said cam follower to a portion of said post extending above said track; and a relatively light weight flexible, closure panel positioned at least partially in said plane, the flanges of said first and second sleeves embracing and supporting horizontal and vertical edges respectively of said panel so that said panel is pivotably disposed about the axis of said post.

4. Apparatus according to claim 1 wherein said fastening means comprises a boss integral with said cam follower and having a substantially horizontal axis.

5. Apparatus according to claim 4 wherein said boss includes a bore normal to the axis thereof, and a pin engaging said bore to secure said first sleeve on said boss.

6. A combination support and automatic closure apparatus for use with a door panel, said apparatus comprising:

a stationary cam track having a substantially semicircular configuration centered on a pivot axis;

a cam follower comprising a support section and a follower section and constrained to follow said track while rotating about said pivot axis, said cam follower being adapted to return to a home position on said track when displaced therefrom;

a boss integral with said support section of said cam follower and having an axis substantially perpendicular to said pivot axis; and a substantially rigid split sleeve coaxially mounted on said boss and adapted to move therewith, said sleeve including a pair of parallel flanges substantially co-extensive with said sleeve in length, said flanges being adapted to fixedly grip and support a panel adjacent the top edge of said panel.

7. Apparatus according to claim 6 and further comprising:

a bearing integral with said cam track and coaxial therewith;

a post journaled in said bearing, said post being at least partially encircled by said cam track and extending above the latter;

means for mounting said cam follower on the extension of said post above said cam track so as to rotate jointly with said post; and a second substantially rigid split sleeve coaxially mounted on said post, said second sleeve including a pair of parallel flanges substantially co-extensive therewith in length;

the flange pairs of said first recited and said second sleeves jointly defining a vertical plane therebetween adapted to rotate about said pivot axis.

8. Apparatus according to claim 7 and further including:

a door rotatably disposed about said pivot axis;

said home position comprising a low point on said track defining a normal position of said door;

said door including a flexible, resilient closure panel positioned at least partially in said plane, said panel being supported at a top horizontal edge thereof by the flanges of said first-recited sleeve and at a side vertical edge thereof by the flanges of said second sleeve.

9. Apparatus according to claim 8 and further including a protective nosing, said nosing including a pair of flanges gripping the opposite vertical panel edge therebetween.

10. A self-closing door comprising:

first and second bearings secured to the jamb of said door and spaced from each other;

a post rotatably supported in said bearings substantially parallel to said jamb and spaced therefrom;

the upper one of said bearings comprising a cam track partially encircling said post and having a low point thereon corresponding to the closed position of said door;

a cam follower comprising a support section and a follower section and positioned on said track and adapted to return to said low point when displaced therefrom, said cam follower being secured to said post so as to rotate therewith;

a boss integral with said support section of said cam follower and having an axis substantially perpendicular to said post;

a first split sleeve coaxially mounted on said boss and adapted to move therewith;

a second split sleeve coaxially mounted on said post;

means for securing said second sleeve to said post so as to rotate therewith;

said first and second sleeves each including a pair of substantially parallel flanges, each of said flange pairs extending substantially the length of the corresponding sleeve; and a relatively light weight, flexible, door panel disposed in a vertical plane jointly defined by the axes of said boss and said post, said panel having top and side edge sections supported by the flanges of said first and second sleeves respectively.

11. A combination support and automatic closure apparatus for use with a door panel, said apparatus comprising:

journaling means including at least one bearing;

a post rotatably supported in said bearing;

a cam track intergral with said bearing;

a cam follower comprising a support section affixed to said post and a follower section disposed to follow said track, said cam follower being adapted to return to a home position on said track when displaced therefrom;

fastening means secured to said support section of said cam follower and extending in a direction substantially perpendicular to said post; and a split sleeve coaxially mounted on said fastening means for movement therewith about the axis of said post;

said sleeve including a pair of parallel flanges running substantially the length thereof;

said flanges being positioned to bracket and support the top edge section of a panel.

12. Apparatus according to claim 11 wherein said fastening means comprises a boss integral with said cam follower and having a substantially horizontal axis.

13. Apparatus according to claim 11 wherein said boss includes a bore normal to the axis thereof, and a pin engaging said bore to secure said first sleeve on said boss.

14. Apparatus according to claim 11 wherein said cam track at least partially encircles said post, said home position comprising a low point on said track defining a normal rotational position of said plane.

15. Apparatus according to claim 14 wherein said journaling means further comprises a second bearing positioned below said first recited bearing and spaced therefrom, said bearings being coaxially mounted on a fixed surface and supporting said post in a substantially vertical position; and means for securing said cam follower to a portion of said post extending about said track.

* * * * *